US010238908B2

(12) United States Patent
Cummings et al.

(10) Patent No.: US 10,238,908 B2
(45) Date of Patent: Mar. 26, 2019

(54) ACCELERATION TRAINER

(71) Applicant: PRO PERFORMANCE SPORTS, L.L.C., Carlsbad, CA (US)

(72) Inventors: Michael Cummings, Carlsbad, CA (US); Monica Miller, Encinitas, CA (US)

(73) Assignee: PRO PERFORMANCE SPORTS, LLC, Carlsbad, CA (US)

( * ) Notice: Subject to any disclaimer, the term of this patent is extended or adjusted under 35 U.S.C. 154(b) by 83 days.

(21) Appl. No.: 15/279,360

(22) Filed: Sep. 28, 2016

(65) Prior Publication Data

US 2018/0085618 A1 Mar. 29, 2018

(51) Int. Cl.
*A63B 21/00* (2006.01)
*A63B 21/02* (2006.01)
(Continued)

(52) U.S. Cl.
CPC ..... *A63B 21/0442* (2013.01); *A63B 21/021* (2015.10); *A63B 21/0557* (2013.01);
(Continued)

(58) Field of Classification Search
CPC ..... A63B 21/0004; A63B 21/00043; A63B 21/00058; A63B 21/00069; A63B 21/00076; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557;
(Continued)

(56) References Cited

U.S. PATENT DOCUMENTS 3,910,234 A 10/1975 Henson
4,019,734 A * 4/1977 Lee ..... A63B 21/0552 482/125
(Continued)

FOREIGN PATENT DOCUMENTS

DE 202015001253 4/2015

OTHER PUBLICATIONS

International Search Report issued in PCT/US2017/054036 dated Nov. 12, 2017 (2 pages).

*Primary Examiner* — Gary D Urbiel Goldner
(74) *Attorney, Agent, or Firm* — Bass Patent Law, LLC

(57) ABSTRACT

A training device includes a tether having inelastic portions disposed between its ends, where each inelastic portion is separated by an elastic portion, and where each of the ends is configured for engagement with hands of a trainer. The training device may include a belt that wraps around an athlete's body, the belt including a ring on a back portion thereof having an opening for receiving an end of the tether therethrough. When the belt is secured around the athlete's body and the tether is disposed through the ring, the training device may create a coupling between the trainer and athlete when the trainer secures the ends of the tether. The coupling may be substantially released when the trainer releases one end of the tether such that the released end is substantially unrestrained to traverse through the ring thereby fully disengaging the tether from the belt.

20 Claims, 8 Drawing Sheets

(51) Int. Cl.
*A63B 21/04* (2006.01)
*A63B 21/28* (2006.01)
*A63B 23/04* (2006.01)
*A63B 21/055* (2006.01)

(52) U.S. Cl.
CPC ..... *A63B 21/285* (2013.01); *A63B 21/4009* (2015.10); *A63B 21/4021* (2015.10); *A63B 21/4027* (2015.10); *A63B 23/047* (2013.01)

(58) Field of Classification Search
CPC ..... A63B 21/065; A63B 21/068; A63B 21/08; A63B 21/15; A63B 21/151; A63B 21/28; A63B 21/285; A63B 21/4009; A63B 21/4023; A63B 21/4025; A63B 21/4027; A63B 21/4033; A63B 21/4035; A63B 21/4039; A63B 21/4041; A63B 21/4043; A63B 69/0028; A63B 69/0057; A63B 69/0059; A63B 69/0064; A63B 2069/0037; A63B 71/0054; A63B 2071/0063; A63B 2071/0072; A63B 2071/0081; A63B 2071/009; A63B 2209/00; A63B 2209/02; A63B 2209/023; A63B 2209/026; A63B 2225/09
See application file for complete search history.

(56) References Cited

U.S. PATENT DOCUMENTS 4,337,938 A 7/1982 Rodriguez
4,404,927 A 9/1983 Woutat
4,544,155 A * 10/1985 Wallenbrock ..... A63B 21/04 473/213
4,955,608 A 9/1990 Dougherty et al.
5,205,803 A 4/1993 Zemitis
5,433,688 A 7/1995 Davies
5,653,668 A * 8/1997 Wilkinson ..... A63B 21/0004 482/121
5,803,881 A 9/1998 Miller
5,813,954 A * 9/1998 Wilkinson ..... A63B 21/0004 482/124
5,951,443 A 9/1999 Askins
6,374,779 B1 4/2002 Miller
6,868,586 B1 * 3/2005 Hall ..... A63B 21/0552 24/115 A
7,384,382 B2 6/2008 Farrah et al.
7,699,761 B1 4/2010 Dieter et al.
7,854,692 B2 12/2010 Prstojevich et al.
7,900,586 B2 3/2011 Hamblen
8,007,419 B2 8/2011 Dieter et al.
8,182,402 B2 5/2012 Prstojevich et al.
8,303,473 B2 11/2012 Gutierrez et al.
8,617,037 B2 12/2013 Dieter et al.
8,727,949 B2 5/2014 Prstojevich et al.
9,345,922 B2 * 5/2016 Allison ..... A63B 21/0442
9,675,838 B2 * 6/2017 Manzke ..... A63B 22/02
9,950,233 B2 * 4/2018 Bilbao ..... A63B 69/182
2001/0029223 A1 * 10/2001 Kallassy ..... A63B 23/0211 482/140
2005/0251895 A1 11/2005 Farrah et al.
2009/0118107 A1 5/2009 Prstojevich et al.
2010/0048363 A1 * 2/2010 Gilberti ..... A63B 21/0603 482/105
2010/0048366 A1 2/2010 Lebert et al.
2010/0062881 A1 * 3/2010 Horkan ..... A63B 69/00 473/439
2010/0173273 A1 * 7/2010 Bilbao ..... A63B 21/4015 434/253
2010/0279831 A1 * 11/2010 Dieter ..... A63B 23/04 482/124
2011/0045954 A1 * 2/2011 Gutierrez ..... A63B 21/00 482/51
2011/0269606 A1 * 11/2011 Dieter ..... A63B 23/04 482/124
2012/0202662 A1 * 8/2012 DeMarco ..... A63B 1/00 482/143
2012/0220436 A1 * 8/2012 Zoltak ..... A63B 21/0552 482/129
2012/0264574 A1 * 10/2012 Chang ..... A63B 69/12 482/55
2013/0143724 A1 * 6/2013 DeMeo ..... A63B 21/00185 482/131
2014/0051549 A1 * 2/2014 Hunter ..... A63B 7/02 482/24
2014/0155233 A1 * 6/2014 Latronica ..... D04G 5/00 482/124
2014/0274613 A1 * 9/2014 DeMarco ..... A63B 21/068 482/139
2015/0182793 A1 * 7/2015 Gutierrez ..... A63B 23/03575 482/124
2015/0297937 A1 * 10/2015 Burkinshaw ..... A63B 21/068 482/124
2015/0343254 A1 * 12/2015 Djang ..... A63B 69/12 482/102
2016/0067578 A1 * 3/2016 Matte ..... A63B 69/12 473/424
2016/0287927 A1 * 10/2016 Hunter ..... A63B 21/4035
2017/0036055 A1 * 2/2017 Fleming ..... A61H 1/0255

* cited by examiner

ACCELERATION TRAINER

CROSS-REFERENCE TO RELATED APPLICATIONS

Not Applicable.

FIELD

The present disclosure generally relates to devices, systems, and methods for exercise or training, and more specifically to devices, systems, and methods related to an acceleration trainer.

BACKGROUND

Acceleration trainers allow an athlete and a trainer to work together to maintain or improve, inter alia, an athlete's acceleration, speed, strength, stamina, and form. Through tethering the athlete to the trainer, the trainer can provide resistance when the athlete strides away from the trainer. If the trainer then releases the tether, the athlete experiences a burst of speed. Acceleration trainers of the prior art include devices where the trainer releases a tether that remains connected to the athlete, i.e., trailing behind the athlete for the remainder of the athlete's run. As such, these devices generally do not experience a completely free release, as the tether can provide resistance as it trails along the ground behind the athlete. Also, these devices can create injury hazards, e.g., if the tether becomes tangled or caught behind an athlete, or they can create tripping hazards. Other acceleration trainers of the prior art include complex "quick-release" designs that feature relatively elaborate mechanical parts such as triggering mechanisms so that a trainer can create a free release of the tether from an athlete by actively triggering a mechanism on one end of the tether that causes movement on an opposite end of the tether to trigger a mechanical release. These devices often feature intricate parts forming complicated, impractical designs that are generally difficult to use, can fail over time, and are relatively expensive to manufacture. Further, many of the acceleration trainers of the prior art experience a "whip-like" effect when the tether is released by the trainer, which can create an injury risk for both the trainer and the athlete.

There remains a need for improved acceleration trainers.

SUMMARY

In an aspect, a training device includes a tether including an elongated body having a plurality of discrete, substantially inelastic portions disposed between ends of the elongated body, where each of the plurality of discrete, substantially inelastic portions are separated from one another along a length of the tether by an elastic portion, and where each of the ends of the elongated body is configured for engagement with hands of a first user. The training device may include a belt structurally configured to wrap around a second user's body and including a securement mechanism structurally configured to secure the belt around the second user's body, the belt further including a ring on a back portion thereof, the ring having an opening for receiving at least one of the ends of the tether therethrough such that each of the ends of the tether are free for engagement with the hands of the first user. When the belt is secured around the second user's body and the tether is disposed through the ring, the training device may be structurally configured to create a coupling between the first user and the second user when the first user secures each of the ends of the tether, where a tension is created in the tether when the second user moves away from the first user while the first user is securing each of the ends of the tether, and where the coupling between the first user and the second user is substantially released when the first user releases one end of the tether such that the released end is substantially unrestrained to traverse through the ring thereby fully disengaging the tether from the belt.

In another aspect, a method of acceleration training may include wrapping a belt around a first user's body and securing the belt around the first user's body such that a ring included on a back portion of the belt is disposed on a back portion of the first user's body, threading one end of a tether through the ring such that each end of the tether is free for engagement by a second user, where the tether includes a plurality of discrete, substantially inelastic portions disposed between the ends of the tether, where each of the plurality of discrete, substantially inelastic portions are separated from one another along a length of the tether by an elastic portion. The method may also include creating a coupling between the first user and the second user through the second user securing each of the ends of the tether, creating a tension in the tether through the first user moving away from the second user while the second user secures each of the ends of the tether, and releasing the coupling between the first user and the second user through the second user releasing one end of the tether such that the released end is substantially unrestrained to traverse through the ring thereby fully disengaging the tether from the belt.

These and other features, aspects and advantages of the present teachings will become better understood with reference to the following description, examples, and appended claims.

BRIEF DESCRIPTION OF THE DRAWINGS

The foregoing and other objects, features and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein. In the drawings, like reference numerals identify corresponding elements.

DETAILED DESCRIPTION

Figure 1:
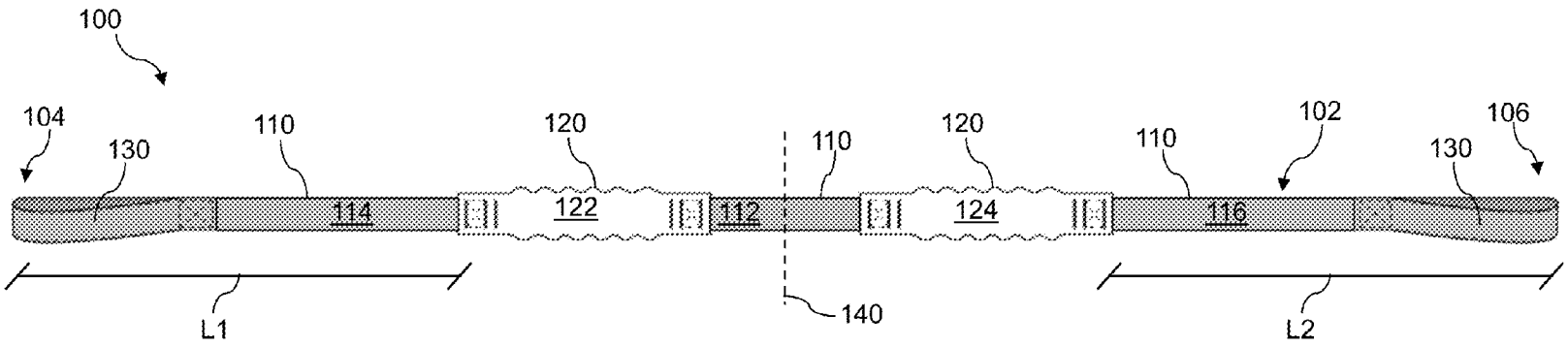
FIG. 1 illustrates a tether of a training device, in accordance with a representative embodiment.

The embodiments will now be described more fully hereinafter with reference to the accompanying figures, in which preferred embodiments are shown. The foregoing may, however, be embodied in many different forms and should not be construed as limited to the illustrated embodiments set forth herein. Rather, these illustrated embodiments are provided so that this disclosure will convey the scope to those skilled in the art.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately," "substantially," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the embodiments.

In the following description, it is understood that terms such as "first," "second," "top," "bottom," "up," "down," and the like, are words of convenience and are not to be construed as limiting terms unless specifically stated to the contrary.

In general, the devices, systems, and methods disclosed herein relate to training devices, e.g., acceleration trainers. Training devices described herein may be useful for a person or athlete to maintain or improve one or more of acceleration, speed, strength, stamina, form, and the like. The training devices described herein may be used by persons or athletes at any level (e.g., amateur or professional, competitive or non-competitive), as well as persons or athletes participating in a wide variety of exercise or sport including without limitation American football, baseball, basketball, soccer, softball, hockey (ice or field), rugby, track & field, cricket, tennis, boxing, cycling, swimming, gymnastics, wrestling, skiing, cross-fit, and so on.

It will be understood that any reference herein to "athlete" or "trainer" shall include any person that may use the devices, systems, and methods disclosed herein.

The training devices described herein may generally feature a belt secured around an athlete's body and a tether threaded through a looped portion of the belt (e.g., a ring or the like). Thus, the training device may be structurally configured to create a coupling between the athlete and a trainer when the trainer grabs, secures, holds, etc., the ends of the tether when the tether is threaded through the looped portion of the belt. A tension or resistance may be created in the tether when the athlete moves away from the trainer (e.g., begins to stride away from the trainer) while the trainer is securing both ends of the tether. The coupling between the athlete and the trainer may be substantially released when the trainer releases one of the ends of the tether such that the athlete may experience a sudden burst of speed when striding away from the trainer, i.e., from the substantial release of tension/resistance. When one end of the tether is released by the trainer, the tether may be substantially unrestrained to traverse through the looped portion of the belt (essentially unraveling or unlooping itself through the looped portion) thereby fully disengaging the tether from the belt.

FIG. 1 illustrates a tether of a training device, in accordance with a representative embodiment. In general, a training device as described herein may include the tether 100 shown in FIG. 1, and the belt 200 shown below in FIG. 2.

The tether 100 may include an elongated body 102 including a first end 104 and a second end 106. As shown in the figure, the first end 104 and the second end 106 may be identical in an embodiment of the tether 100. In an alternate embodiment of the tether 100, the first end 104 and the second end 106 may be different, e.g., they may include different holds 130 as described herein.

The tether 100 may include a plurality of discrete, substantially inelastic portions 110 disposed along a length of the tether 100, i.e., along the elongated body 102 between the first end 104 and the second end 106. Each of the inelastic portions 110 may be separated from one another along the length of the tether 100 by an elastic portion 120. Thus, the elongated body 102 of the tether 100 may include one or more inelastic portions 110 and one or more elastic portions 120.

One or more of the inelastic portions 110 may include a strap-like member, e.g., a woven fabric strap or the like. One of ordinary skill will appreciate that almost any material has some degree of elasticity, and that the substantially inelastic portions 110 may include a material that is relatively inelastic compared to relatively elastic materials—e.g., a woven fabric strap made of nylon (or the like) is substantially inelastic compared to rubber or the like. Thus, in an aspect, one or more of the inelastic portions 110 include a woven fabric strap comprising nylon or the like.

One or more of the elastic portions 120 may include a bungee or the like. In an aspect, one or more of the elastic portions 120 includes a rubber cord substantially covered by a fabric sheathing. In an aspect, an unstretched length of one or more of the elastic portions 120 is between about 285 mm and about 335 mm. In an aspect, a maximum stretched length of one or more of the elastic portions 120 during a standard use is between about 570 mm and about 670 mm, where a standard use includes a first user (e.g., a trainer) tethered to a second user (e.g., an athlete) that is moving away from the first user (e.g., an athlete taking strides away from the trainer). For example, an aspect includes an elastic portion 120 having an unstretched length of about 310 mm and a stretched length of about 620 mm.

In general, the tether 100 may include one or more elastic portions 120, e.g., portions that can expand and contract from an at-rest, unstretched length when pulling forces are applied to the tether 100, with each elastic portion 120 having an ability to spring back substantially to its at-rest, unstretched length. And the tether 100 may include one or more inelastic portions 110, e.g., portions that remain static (i.e., generally do not expand and contract from an at-rest length) when pulling forces are applied to the tether 100.

The embodiment of the tether 100 shown in the figure includes three inelastic portions 110 and two elastic portions 120. Specifically, as shown in the figure, in an embodiment, the plurality of discrete, substantially inelastic portions 110 may include a central portion 112 disposed about halfway along the length of the tether 100 such that it is intersected by a central axis 140, a first end portion 114 disposed along the length of the tether adjacent to the first end 104, and a second end portion 116 disposed along the length of the tether 100 adjacent to the second end 106. As discussed herein, each of the inelastic portions 110 may be separated from one another by elastic portions 120, and as such, in the embodiment shown in the figure, the elastic portions 120 of the tether 100 further include a first elastic portion 122 disposed between the first end portion 114 and the central portion 112, and a second elastic portion 124 disposed between the second end portion 116 and the central portion 112.

In an aspect, the first end portion 114 is at least 2.5 times longer than the central portion 112. The second end portion 116 may also or instead be at least 2.5 times longer than the central portion 112. In an aspect, the length L1 from the first end 104 to an adjacent elastic portion 120 (e.g., the first elastic portion 122) is between about 490 mm and about 510 mm, e.g., the length L1 may be about 500 mm. In an aspect, the length L2 from the second end 106 to an adjacent elastic portion 120 (e.g., the second elastic portion 124) is between about 490 mm and about 510 mm, e.g., the length L2 may be about 500 mm. Other lengths for L1 and L2 are also possible. Additionally, in an aspect, the length L1 substantially equals the length L2, and in another aspect these lengths L1, L2 are different.

In an aspect, a central portion 112 disposed about halfway along the length of the tether 100 includes a length between about 170 mm to about 180 mm, as measured from the ends of adjacent elastic portions 120. For example, the length of the central portion 112 may be about 175 mm in an aspect.

In an aspect, one or more of the inelastic portions 110 include a width of about 50 mm. Further, one or more of the inelastic portions 110 may include a thickness of about 1 mm.

Although the embodiment of the tether 100 shown in the figure includes three inelastic portions 110 and two elastic portions 120, one of skill in the art will recognize that more or less inelastic portions 110 and more or less elastic portions 120 are possible, and other combinations of inelastic portions 110 and elastic portions 120 are possible. For example, although the embodiment of the tether 100 shown in the figure includes more inelastic portions 110 than elastic portions 120, one of skill in the art will recognize that embodiments may include a tether 100 having more elastic portions 120 than inelastic portions 110, or a tether 100 where the number of elastic portions 120 and inelastic portions 110 may be equal. For example, an aspect may include one elastic portion 120 that separates two inelastic portions 110, or one inelastic portion 110 that separates two elastic portions 120. Another aspect may include three elastic portions 120 that separate four inelastic portions 110, or three inelastic portions 120 that separate four elastic portions 120. Other combinations are also possible, which will be apparent to a person of ordinary skill in the art.

In an aspect, the central portion 112 of the tether is inelastic as shown in the figure. In another aspect, the central portion 112 of the tether is elastic. Also, in an aspect, the central portion 112 of the tether includes a feature for cooperating with a looped portion (e.g., a ring) of a belt worn by an athlete. The feature on the central portion 112 may include a fold, an indent, a projection, or the like.

In an alternate embodiment, the elongated body 102 of the tether 100 is entirely elastic, or entirely inelastic.

As shown in the figure, each of the ends of the tether 100 (i.e., the first end 104 and the second end 106) may be structurally configured for engagement with the hands of a first user (e.g., a trainer). As such, a training device may include one or more holds 130 disposed on one or more ends of the tether 100 (i.e., the first end 104 and the second end 106 of the tether 100), where the one or more holds 130 are structurally configured for engagement with at least one hand of a first user (e.g., a trainer).

The hold 130 may be structurally configured for securement by one or more hands (or other body parts) of a first user (e.g., a trainer). The hold 130 may be structurally configured such that a first user (e.g., a trainer) can easily release the hold 130 on at least one end of the tether 100 with at least one hand. The hold 130 may also or instead be structurally configured such that a first user (e.g., a trainer) can remain engaged with the hold 130 on one end of the tether 100 when an opposite end of the tether 100 is released by the first user.

In an aspect, the first user (e.g., a trainer) may secure an end of the tether 100 (e.g., using a hold 130) while simultaneously gripping the opposite end of the tether 100 (e.g., using a hold 130). For example, the first user may have the first end 104 of the tether 100 secured in their right hand (e.g., using a hold 130) and the second end 106 of the tether 100 secured in their left hand (e.g., using a hold 130). In an aspect, the coupling between the first user (e.g., a trainer) and a second user (e.g., an athlete) is substantially released when the first user releases their grip on one of the ends of the tether 100 (e.g., by releasing the hold 130). The first user may maintain their grip on one of the ends of the tether 100 while the released end (the opposite end) remains free for de-threading itself through a ring or the like included on the belt of the trainer (see FIG. 2) as the second user moves away from the first user (e.g., the athlete takes strides away from the trainer).

In this manner, one or more of the first end 104 and the second end 106 may include a hold 130 to enable (or otherwise provide for ease of) engagement with a trainer. For example, in an aspect, a first user (e.g., a trainer) may secure an end of the tether 100 (e.g., the first end 104) using the hold 130 while simultaneously gripping the opposite end of the tether 100 (e.g., the second end 106). The coupling between the first user and the second user may be substantially released when the first user releases their grip on one of the ends of the tether 100 (e.g., the second end 106) while maintaining their engagement with the hold 130 on the opposite end of the tether 100 (e.g., the first end 104). One of skill in the art will recognize that references to the first end 104 and the second end 106 herein are done for convenience and by way of example. Thus, alternatively, the first user may release their grip on the first end 104 of the tether 100 while maintaining their engagement with the second end 106 of the tether 100 (e.g., using a hold 130 disposed on the second end 106).

As shown in FIG. 1, the hold 130 may include a loop for placement of at least one hand of a first user (e.g., a trainer) through the loop for securing the loop around a wrist of the first user. The loop may be formed in manufacturing by folding over an end of the tether 100, e.g., where the tether 100 is made at least in part from a woven fabric strap. A loop or the like may be advantageous because such a loop can be used as both a feature to secure around a user's wrist and/or for simply grabbing with a user's hand with or without wrapping around a user's wrist. Thus, in an aspect, a trainer secures one loop around their wrist (i.e., on the end of the tether 100 that they will remain connected to throughout a training exercise) and grabs the other loop with their other hand (i.e., on the end of the tether 100 that they will release in a training exercise). The hold 130 may also or instead include other features for securing around a user's wrist and/or for gripping by a user (e.g., a trainer).

The hold 130 may also or instead include one or more of a handle, a strap for strapping around a wrist of a first user (e.g., a trainer), or the like. The hold 130 may also or instead include a securement means such as a button, a hook and loop portion, a hook, a clasp, a ring, a tie, and so forth.

As stated above, the hold 130 may be disposed on one or more of the ends of the tether 100, i.e., the first end 104 and the second end 106 of the tether 100. The hold 130 may be integral with one or more of the ends of the tether 100, e.g., thereby forming one or more of the ends of the tether 100. In an aspect, one or more of the ends of the tether 100 include substantially inelastic portions, and as such the holds 130 may be substantially inelastic. In another aspect, one or more of the ends of the tether 100 include substantially elastic portions, and as such the holds 130 may be substantially elastic.

In an aspect, and as shown in FIG. 1, the hold 130 may be disposed on both ends of the tether 100, i.e., on each of the first end 104 and the second end 106 of the tether 100. In this manner, the tether 100 may be substantially symmetric about a central axis 140 disposed between the ends of the tether 100, i.e., the first end 104 and the second end 106.

The tether 100 may thus include a first hold on the first end 104 of the tether 100 and a second hold on the second end 106 of the tether 100. In an aspect, the second hold is the same as the first hold. In an alternate aspect, the second hold is different from the first hold.

The one or more elastic portions 120 may act as a shock absorber for the training device. For example, one or more of the elastic portions 120 may act as a shock absorber that dissipates energy such that the tether 100 does not snap back and contact the first user (e.g., trainer) when one end of the tether 100 is released. One or more the elastic portions 120 may also or instead act as a shock absorber that allows the first user (e.g., trainer) to withstand a relatively abrupt change in velocity of the second user (e.g., athlete) when coupled. In this manner, the combination of the inelastic portions 110 and the elastic portions 120 may allow a trainer to take a direct burst of power from the athlete when training using the training device.

Figure 2:
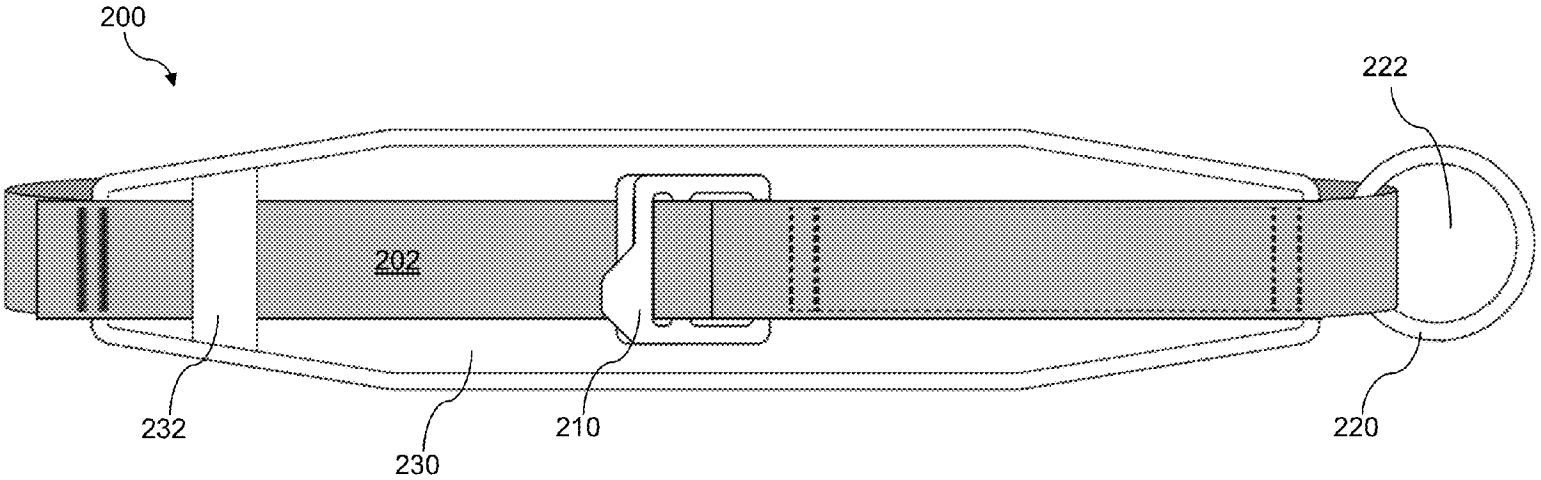
FIG. 2 illustrates a belt of a training device, in accordance with a representative embodiment.

The one or more elastic portions 120 may allow for substantially even tension from a portion of the tether 100 engaged with the belt (e.g., a portion of the tether 100 in engagement with a ring disposed on the belt—see FIG. 2) to each of the ends of the tether 100, e.g., from a central portion 112 to each of the first end 104 and the second end 106. In other words, one or more of the elastic portions 120 may allow for substantially even tension between a first portion of the tether 100 (e.g., extending from the belt to the first end 104) and a second portion of the tether 100 (e.g., extending from the belt to the second end 106).

The combination of the inelastic portions 110 and the elastic portions 120 may also or instead allow for a trainer to hold the ends of the tether 110 such that lengths of the tether 100 extending from the belt to the ends held by the trainer are substantially even in length, and/or are substantially parallel. The term "parallel" as used in this context may be relative. That is, when a trainer holds the ends of the tether 110 that is connected to the belt worn by an athlete, these ends may form an angle having a vertex at the ring or connection point of the belt and the tether 110 (see, e.g., FIG. 10). If the trainer's hands are relatively close together, the lengths of the tether 110 extending from the ring of the belt may be substantially parallel as compared to when the trainer's hands are spread apart. To this end, the combination of the inelastic portions 110 and the elastic portions 120 may allow for substantially equal force to be applied in each length of the tether 100 extending from the belt, regardless of the hand positions of the trainer.

The combination of the inelastic portions 110 and the elastic portions 120 may also or instead allow for errors in a trainer holding the ends of the tether 110, e.g., at angles that are not generally preferred when training such as angles that create inconsistent forces on the athlete (e.g., when holding the ends such that lengths of the tether 100 are substantially non-parallel to one another, i.e., the trainer's hands are substantially spread apart). The combination of the inelastic portions 110 and the elastic portions 120 may also or instead allow for errors in a trainer holding the ends of the tether 110 such that the lengths of the tether 100 extending from the belt are not substantially even in length. The combination of the inelastic portions 110 and the elastic portions 120 may also or instead generally provide leeway and give, e.g., to prevent injury to the trainer or athlete.

The ratio of the number and the sizes of the inelastic portions 110 and the elastic portions 120 may also or instead allow for the dissipation of energy such that the tether 100 does not snap-back at the athlete or trainer upon its release.

FIG. 2 illustrates a belt of a training device, in accordance with a representative embodiment. In general, the belt 200 may be structurally configured to be wrapped around a second user's (e.g., an athlete's) body and secured thereto, and may include a component for the tether (see FIG. 1) to be looped through as explained below.

The belt 200 may include a strap 202 configured for wrapping partially or entirely around the second user's (e.g., the athlete's) body. The strap 202 may include a fabric strap, e.g., a woven fabric strap including nylon. The strap 202 of the belt 200 may be the same or similar to the inelastic portions of the tether described above. In an aspect, the strap 202 includes a logo or brand name thereon, e.g., sewn into the strap 202 or affixed thereon. One or more portions of the strap 202 may include double stitching, which may include portions of a nylon webbing doubled over and secured by two or more zig-zag stitches. In an aspect, the strap 202 includes a thickness of about 1.5 mm.

The belt 200 may include a securement mechanism 210 structurally configured to secure the belt 200 around the second user's (e.g., the athlete's) body. The securement mechanism 210 may include a buckle, a clasp, a clamp, a clip, male and female cooperating members, a friction fit, a hook and loop fastener (e.g., hook and loop fasteners similar to those sold under the trademark VELCRO or the like), a latch, a snap, a ratcheting device, and the like. In an aspect, the securement mechanism 210 includes a 2 inch buckle and a cooperating 2 inch D-ring (other sizes are also or instead possible) for threading the strap 202 therethrough.

The belt 200 may include a ring 220. The ring 220 may be disposed on a back portion of the belt 200 such that, when the belt 200 is secured around the second user's (e.g., the athlete's) body, the ring 220 is similarly disposed on the back of the second user's body. The ring 220 may include an opening 222 for receiving at least one of the ends of the tether therethrough such that each of the ends of the tether are free for engagement with the hands of a first user (e.g., a trainer).

The ring 220 may include a 'ring' in the traditional sense, or any looped portion of the belt 200, any component of the belt 200, or any component engaged to the belt 200, that includes an opening 222 for receiving at least one of the ends of the tether therethrough.

In an aspect, the ring 220 includes a substantially rounded shape. For example, the ring 220 may be substantially circular. In an aspect, the ring 220 includes a circular shape having a diameter of about 65 mm. The ring 220 may also or instead include other shapes, such as other curved shapes including without limitation ovals, ellipses, cylinders, oblongs, and the like. The ring 220 may also or instead include a polygonal shape such as a square, a rectangle, a triangle, a pentagon, and the like. The ring 220 may also or instead include a fanciful shape such as a star, the shape of a logo or brand name, a shape resembling a sporting item (e.g., a football), an animal, a character, a person, an object, and so forth.

The ring 220 may include steel, e.g., the ring 220 may be made entirely of steel. The ring 220 may also or instead be made of other materials including other metals, plastics, ceramics, and the like.

In an aspect, the ring 220 includes a clasp. For example, the ring 220 may include a carabiner or the like. The ring 220 may also or instead include a hook or the like. For example, the ring 220 may include a spring hook, a bolt snap, a swivel hook, a swivel ring, and the like.

The ring 220 may be secured to the belt 200 such that it is free to rotate, e.g., the ring 220 may be able to freely rotate 360 degrees. In another aspect, the ring 220 may be secured to the belt 200 such that it cannot rotate, or such that the ring 220 can only rotate a predetermined amount.

The ring 220 may include one or more substantially smoothed surfaces or edges. In this manner, when an end of the tether is released, the released end of the tether may be able to traverse through the ring 220 and fully disengage the tether from the belt 200 with minimal friction between the tether and the ring 220.

The belt 200 may include a support 230. The support 230 may include a padded portion or the like comprising a foam material or the like. In an aspect, the support 230 may include foam covered by a fabric material, e.g., a polyester or the like. The edges of the support 230 may be made of a nylon binding or the like, e.g., for strength. The support 230 may include one or more loops 232 or the like for engaging with the strap 202. The loops 232 may include a nylon material, e.g., a nylon webbing or the like, e.g., for strength. In an aspect, the support 230 includes a logo or brand name thereon.

In use, the belt 200 may be secured around the second user's body (e.g., the athlete's body) and an end of the tether may be disposed through the ring 220. The training device may be structurally configured to create a coupling between the first user (e.g., the trainer) and the second user when the first user secures each of the ends of the tether after the tether is disposed through the ring 220. A tension may be created in the tether when the second user moves away from the first user (e.g., the second user takes strides away from the first user) while the first user is securing each of the ends of the tether. The coupling between the first user and the second user may be substantially released when the first user releases one of the ends of the tether such that the released end is substantially unrestrained to traverse through the ring 220 thereby fully disengaging the tether from the belt 200.

To secure the belt 200 around a user's body, the strap 202 may be pulled under the loop 232 of the support 230. The strap 202 may then be threaded through the securement mechanism 210 and pulled tight, e.g., the strap 202 may be pulled through rings of a buckle and looped back through one of the rings of the buckle—e.g., in a manner similar to many strap securement/adjustment devices known in the art, any of which may be included herein.

Figure 3:
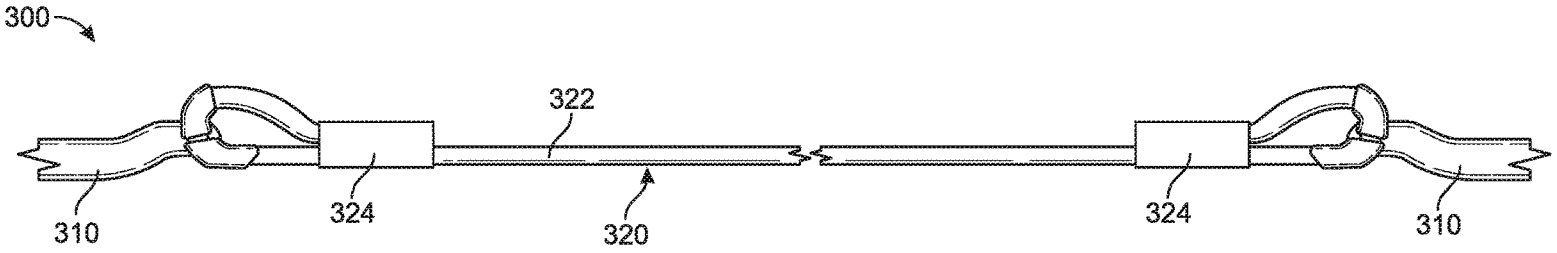
FIG. 3 illustrates a portion of a tether of a training device, in accordance with a representative embodiment.

FIG. 3 illustrates a portion of a tether of a training device, in accordance with a representative embodiment. The portion of the tether 300 shown in the figure includes an elastic portion 320 coupled to adjacent inelastic portions 310.

The elastic portion 320 may include a cord 322 made of an elastic material, e.g., rubber or the like. In an embodiment, the cord 322 may be covered by a fabric sheathing or the like, e.g., a fabric sheathing made of nylon or the like. The cord 322 may form a resistance band for the tether 300. In an aspect, the cord 322 may include a rubber resistance band having a length between about 285 mm and about 295 mm (e.g., the cord 322 may have a length of about 290 mm). In an aspect, the cord 322 is substantially tubular in shape. In an aspect, the cord 322 is substantially cylindrical in shape, e.g., including an outer diameter of about 13 mm and an inner diameter of about 4 mm.

The inelastic portions 310 may include a woven fabric strap made primarily of a substantially inelastic material (relative to the elastic material of the elastic portion 320) such as nylon or the like.

As shown in FIG. 3, engagement between an inelastic portion 310 made of a woven fabric strap and an elastic portion 320 made of a rubber cord 322 may be facilitated by wrapping the woven fabric strap around doubled-over ends of the rubber cord 322, and securing a free end of the doubled-over rubber cord 322 with a securement band 324 or the like. In an aspect, the inelastic portion 310 is connected to the doubled-over elastic portion 320 via a girth-hitch connection or the like, which may be further secured by a knot.

In an aspect, the securement band 324 is made of rubber. For example, the securement band 324 may include a rubber band binding that is tubular in shape, e.g., having an outer diameter of about 12 mm, an inner diameter of about 7 mm, and a length of about 24 mm. The securement band 324 may be coupled to the cord 322 using an adhesive, a gripping material, a mechanical component, a heat treating, and the like.

When the elastic portions 320 are substantially covered by a sheathing or the like, engagement of the sheathing to an adjacent inelastic portion 310 may be provided by a box stitch or the like.

Figure 4:
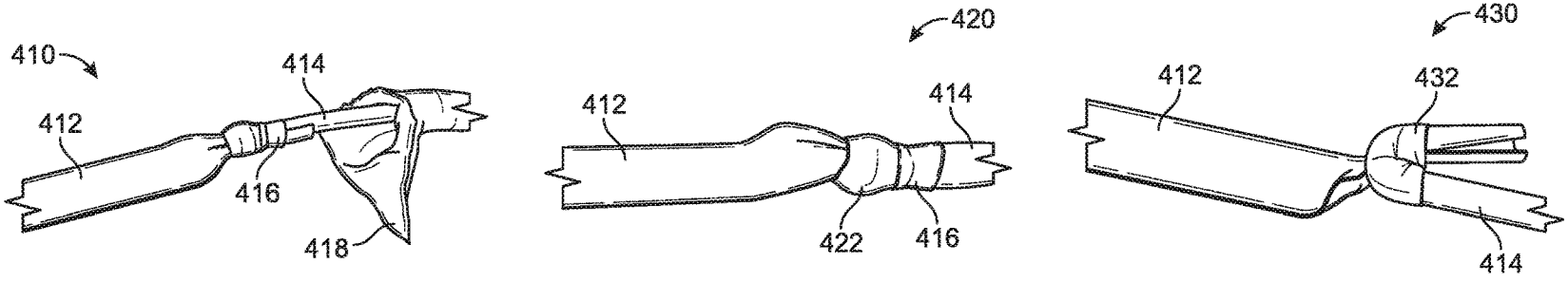
FIG. 4 illustrates portions of a tether of a training device, in accordance with a representative embodiment.

FIG. 4 illustrates portions of a tether of a training device, in accordance with a representative embodiment. Specially, the figure shows a first image 410 including a tether, a second image 420 showing a close-up view of a tether, and a third image 430 showing a connection between the elastic portion and the inelastic portion of a tether.

The first image 410 includes a sheathed resistance band assembly, which may form a portion of a tether as described herein. The assembly may include an inelastic portion 412 in the form of a webbed nylon strap, and an elastic portion 414 in the form of a rubber cord, which may form the resistance band for a tether as described herein. The first image 410 also includes a binding 416 in the form of a rubber securement band for coupling the inelastic portion 412 to the elastic portion 414. The first image 410 further includes a sheathing 418 for covering at least a portion of the elastic portion 414. In the first image 410, the sheathing 418 has been torn away to expose the elastic portion 414. The sheathing 418 may include a nylon fabric material or the like, e.g., similar to the material used for the inelastic portion 412, but including addition material to accommodate expansion and contraction of the elastic portion 414. The sheathing 418 may also or instead include another material, such as a relatively elastic material including a rubber, foam, or the like. The sheathing 418 may include a shape forming a fanciful design in an aspect, e.g., an accordion-like shape.

The second image 420 includes a close-up view of the connection between the inelastic portion 412 and the elastic portion 414. As discussed herein, the coupling may include doubling over one or more of the inelastic portion 412 or the elastic portion 414, and securing the doubled-over portion with the binding 416. One or more knots 422 or the like may also or instead be formed to provide the connection between the inelastic portion 412 and the elastic portion 414.

The third image 430 includes a view showing the elastic portion 414 doubled over for providing an end 432 in which to connect the inelastic portion 412.

Figure 5:
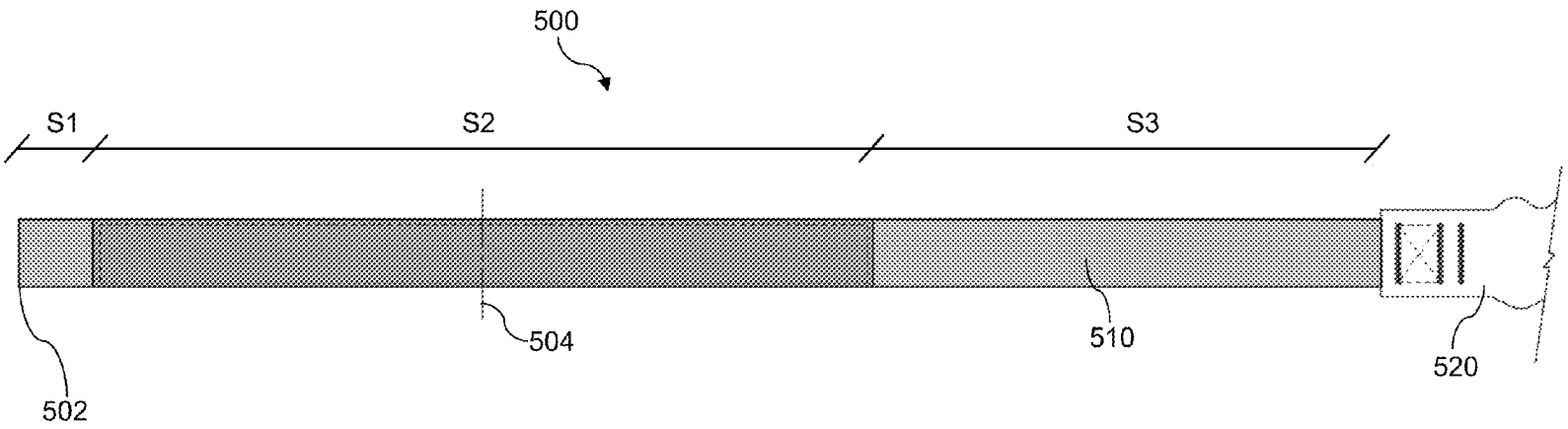
FIG. 5 illustrates a portion of a tether of a training device, in accordance with a representative embodiment.

FIG. 5 illustrates a portion of a tether of a training device, in accordance with a representative embodiment. Specifically, the figure shows an end of the tether 500. A shown in the figure, the end of the tether 500 may include an inelastic portion 510 in the form of a strap that comes to a terminal end 502. In another aspect, the end of the tether 500 may include a hold, which may be formed by folding the terminal end 502 about a fold line 504 and securing the terminal end 502 to a downstream portion of the strap, e.g., using a box stitch or the like. The folding over of the terminal end 502 of the inelastic portion 510 may form a hold such as that shown in FIG. 6. Specifically, FIG. 6 illustrates a handle 530 of a tether 600 of a training device, in accordance with a representative embodiment.

Figure 6:
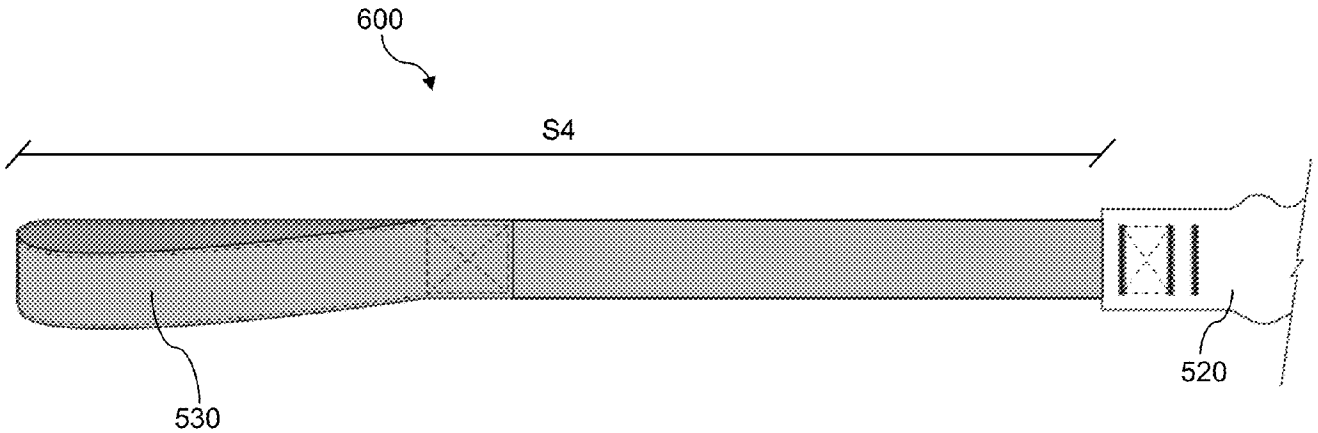
FIG. 6 illustrates a handle of a tether of a training device, in accordance with a representative embodiment.

Several lengths of sections of the inelastic portion 510 shown in FIGS. 5 and 6 are described herein, although other lengths are also or instead possible. In an aspect, a first section 51 may include a length between about 25 mm and about 35 mm (e.g., about 30 mm), where the first section 51 provides an area for the terminal end 502 to be secured to the strap. In an aspect, a second section S2 may include a length between about 465 mm and about 475 mm (e.g., about 470 mm), where the second section S2 represents a grippable portion of the handle 530. In an aspect, a third section S3 may include a length between about 260 mm and about 270 mm (e.g., about 265 mm), where the third section S3 includes the length from a connection of the handle 530/strap to an adjacent elastic portion 520. In an aspect, a fourth section S4 may include a length between about 490 mm and about 510 mm (e.g., about 500 mm), where the fourth section S4 includes the length from an end of the handle 530 to an adjacent elastic portion 520.

Figure 7:
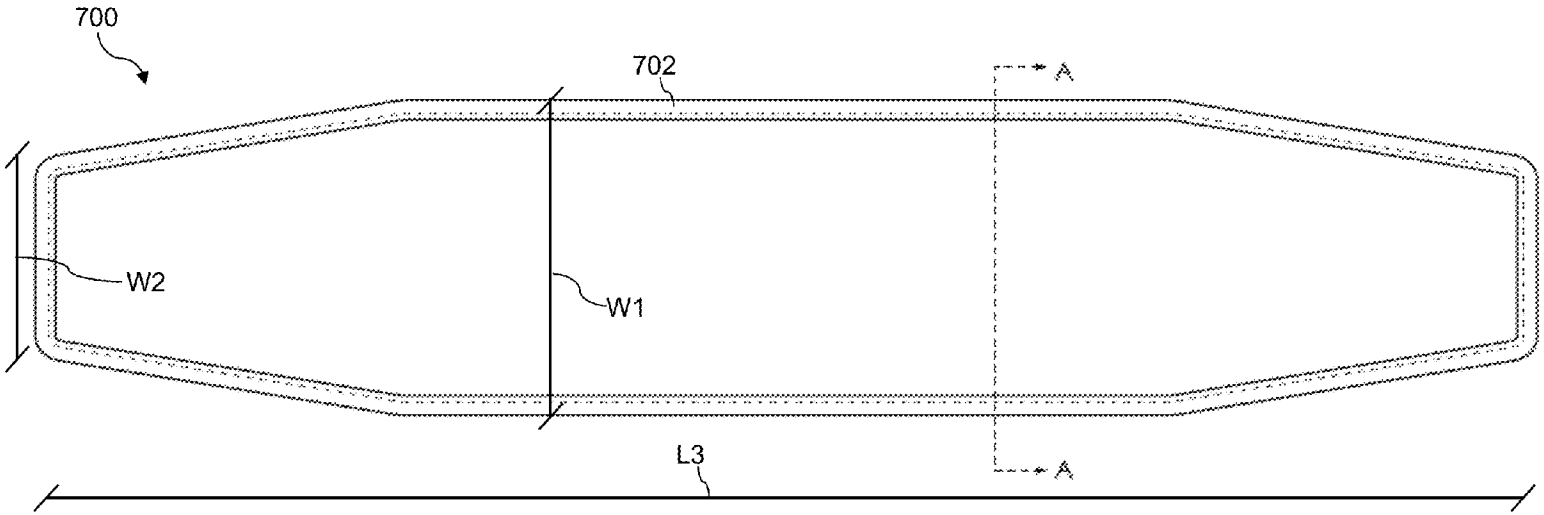
FIG. 7 illustrates a support of a belt of a training device, in accordance with a representative embodiment.

FIG. 7 illustrates a support of a belt of a training device, in accordance with a representative embodiment. The support 700 may include a padded portion or the like comprising a foam material or the like covered by a fabric material, e.g., a polyester or the like.

The edges 702 of the support 700 may be bound using nylon or the like for strength. The edges 702 may be about 10 millimeters in thickness.

In an aspect, an overall length L3 of the support 700 is between about 478 mm and about 488 mm (e.g., about 483 mm). In an aspect, a width W1 of a first portion of the support 700 is between about 97 mm and about 107 mm (e.g., about 102 mm). In an aspect, a width W2 of a second portion of the support 700 is between about 46 mm and about 56 mm (e.g., about 51 mm).

One skilled in the art will recognize that the support 700 may include a different shape than that shown in the figure. For example, the support 700 may include only one width across its entire length—e.g., the support 700 may include a substantially rectangular or oblong shape. The support 700 may also or instead include rounded edges or rounded features, e.g., between the first portion of the support 700 and the second portion of the support 700.

Figure 8:
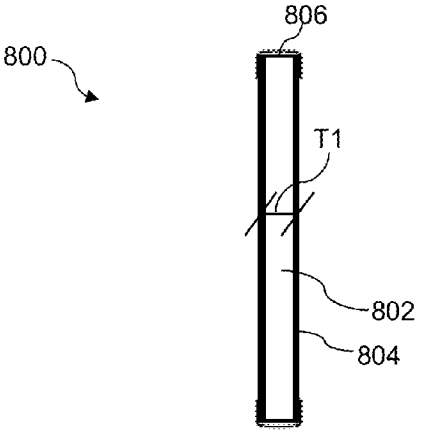
FIG. 8 illustrates a cross-section of a support of a belt of a training device, in accordance with a representative embodiment.

FIG. 8 illustrates a cross-section of a support of a belt of a training device, in accordance with a representative embodiment. In particular, FIG. 8 shows a cross-section of a support 800 taken from Section A-A from FIG. 7. In the figure, the padded portion 802 (which may be made of a foam material or the like), a covering 804 (which may be made of a polyester material or the like), and the edges 806 (which may be bound by a nylon material or the like) of the support 800 are shown. In an aspect, a thickness T1 of the support 800 is between about 4 mm and about 14 mm (e.g., about 9 mm).

Figure 9:
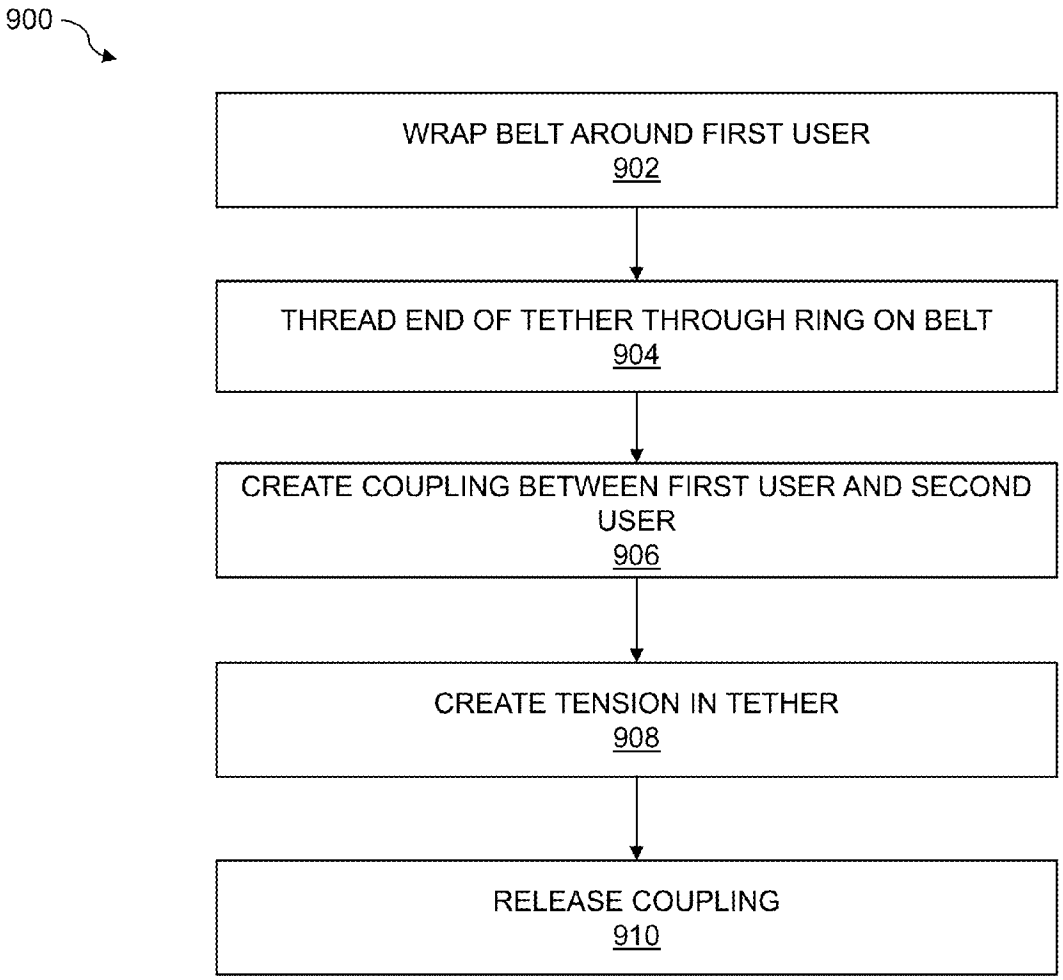
FIG. 9 is a flow chart of a method of training, in accordance with a representative embodiment.

FIG. 9 is a flow chart of a method of training (e.g., acceleration training), in accordance with a representative embodiment. Specifically, the method 900 may include a training method using a training device as described herein, e.g., an acceleration trainer.

As shown in step 902, the method 900 may include wrapping a belt around a first user's body (e.g., an athlete's body) and securing the belt around the first user's body such that a ring included on a back portion of the belt is disposed on a back portion of the first user's body.

It will be noted that the first user in the method 900 may be the athlete (or a person training or exercising) and the second user in the method 900 may be a trainer, coach, helper, training partner, spotter, or the like. It will generally be understood that the first user, second user language used for the method 900 (and used elsewhere in the disclosure) are terms of convenience for introducing users, and are not to be interpreted as limiting the practice or use of the training devices or methods described herein.

As shown in step 904, the method 900 may include threading at least one end of a tether through the ring such that each end of the tether is free for engagement by a second user (e.g., a trainer).

As discussed herein, the tether may include a plurality of discrete, substantially inelastic portions disposed between the ends of the tether, where each of the plurality of discrete, substantially inelastic portions are separated from one another along a length of the tether by an elastic portion.

As shown in step 906, the method 900 may include creating a coupling between the first user and the second user through the second user securing each of the ends of the tether. The coupling may be created by the second user grabbing a hold disposed on one or more of the ends of the tether. For example, in an aspect, a trainer secures one end of the tether to his/her wrist by placing their hand through a loop on the end of the tether, and the trainer secures the opposite end of the tether by grabbing the opposite end with his/her other hand (e.g., using a hold disposed thereon).

As shown in step 908, the method 900 may include creating a tension in the tether through the first user moving away from the second user while the second user secures each of the ends of the tether. For example, the athlete may begin to take strides away from the trainer that is holding both ends of the tether.

As shown in step 910, the method 900 may include releasing the coupling between the first user and the second user through the second user releasing one end of the tether such that the released end is substantially unrestrained to traverse through the ring thereby fully disengaging the tether from the belt. Thus, as the athlete continues to take strides away from the trainer, the released end of the tether may continue to de-thread through the ring (e.g., slip out of the ring) until the tether is fully disengaged from the belt. The trainer releasing an end of the tether may cause a sudden burst of speed (i.e., increase in acceleration) in the athlete.

Figure 10:
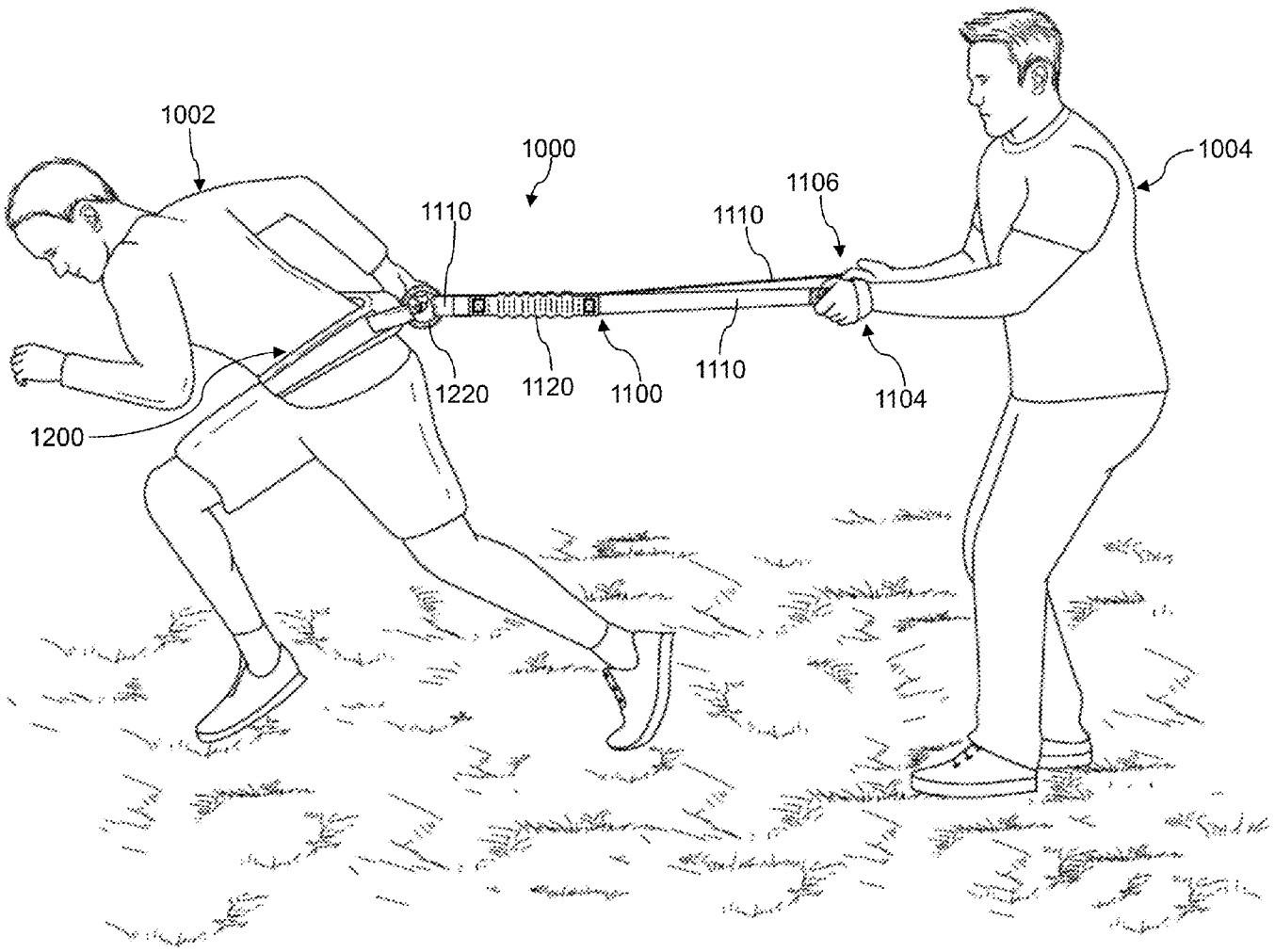
FIGS. 10-12 illustrate a training device in use, in accordance with a representative embodiment.
Figure 11:
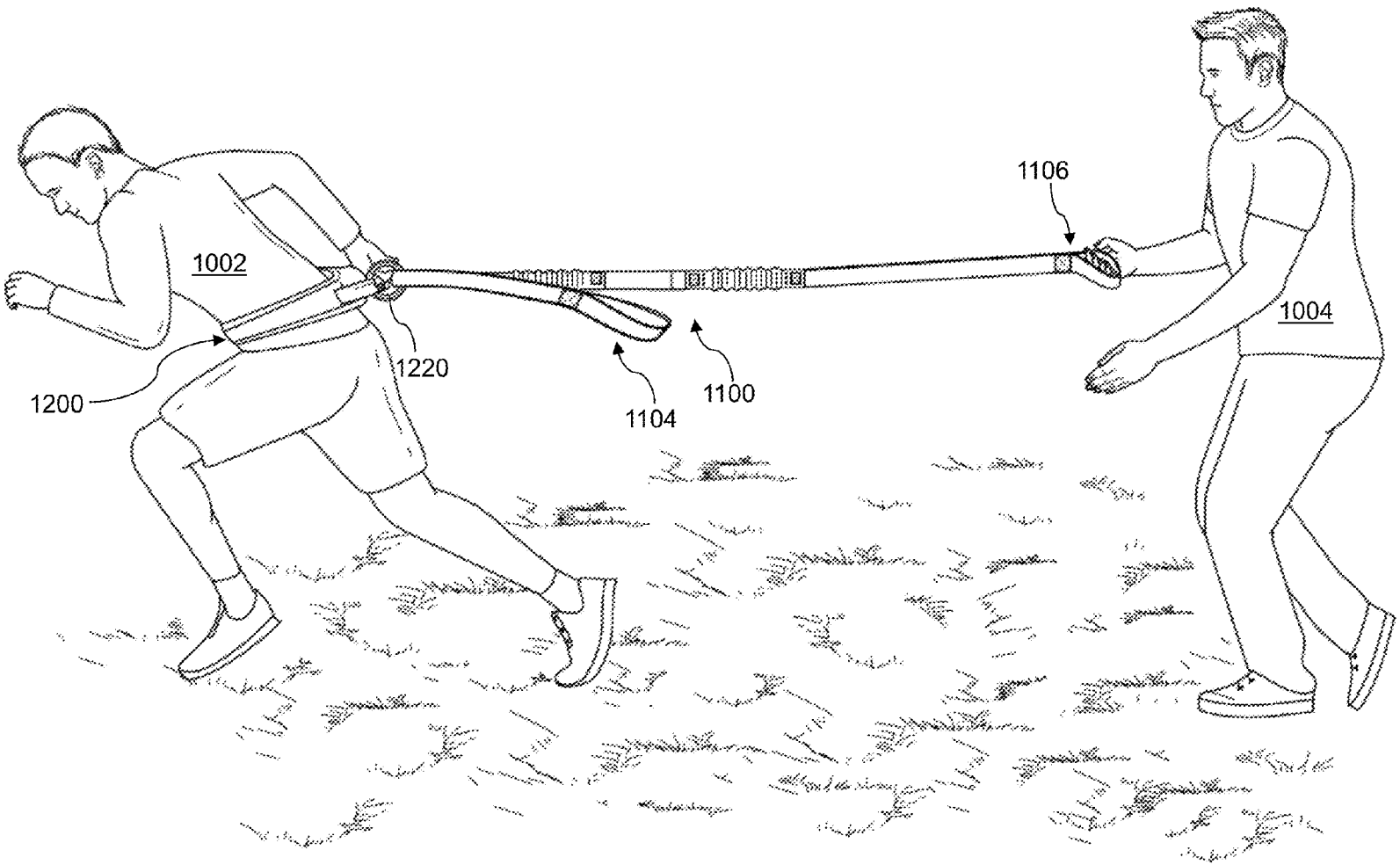
Figure 12:
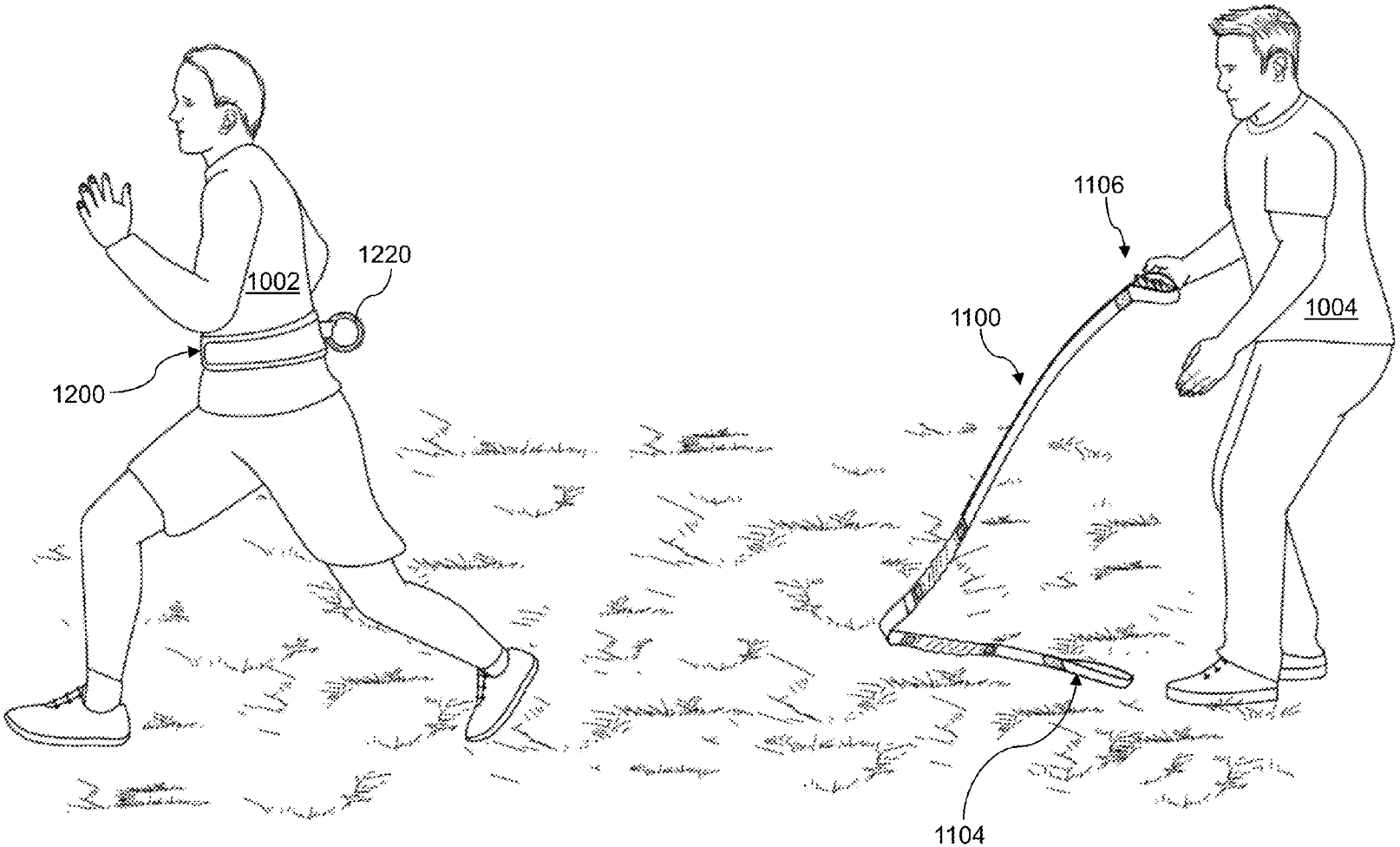

FIGS. 10-12 illustrate a training device in use, in accordance with a representative embodiment.

As shown in FIG. 10, the training device 1000 may include a tether 1100 and a belt 1200. The tether 1100 may include an elongated body having a first end 1104 and a second end 1106, with a plurality of inelastic portions 1110 and a plurality of elastic portions 1120, where each of the inelastic portions 1110 is separated from one another by an elastic portion 1120.

The belt 1200 may be secured around a user (e.g., an athlete 1002) and include a ring 1220 disposed on a back portion thereof, where the tether 1100 is disposed through an opening in the ring 1220 such that the first end 1104 and the second end 1106 of the tether 1100 are free for another user (e.g., a trainer 1004) to secure in their hands, e.g., grab hold of, loop around their wrist, or the like, or a combination thereof.

As shown in FIG. 10, in use, the tether 1100 may be threaded through the ring 1220 and the trainer 1004 may grab a hold of each of the first end 1104 and the second end 1106 of the tether 1100 using their hands. The trainer 1004 may also or instead loop a portion of the end of the tether 1100 around their wrist as shown in the figure. The athlete 1002 may take strides away from the trainer 1004 as shown in the figure, which puts a tension in the tether 1100 and provides resistance against the motion of the athlete 1002 when the trainer 1004 maintains their position or otherwise provides a force in a direction opposite the athlete 1002. As shown in the figure, the trainer 1004 may attempt to keep even lengths of the tether 1100 extending from the ring 1220 in each of their left and right hands. Furthermore, the trainer 1004 may attempt to keep lengths of the tether 1100 extending from the ring 1220 substantially parallel to one another.

As shown in FIG. 11, the trainer 1004 may release their grip/hold on the first end 1104 of the tether 1100 during a training exercise when the athlete 1002 is taking strides away from the trainer 1004. This may cause the tether 1100 to freely unravel from the ring 1220 of the belt 1200 as the athlete 1002 moves away from the trainer 1004 and the trainer 1004 maintains their grip/hold on the second end 1106 of the tether 1100.

As shown in FIG. 12, the athlete 1002 may continue to take strides away from the trainer 1100 during a training exercise after the trainer 1004 has released their grip/hold on the first end 1104 of the tether 1100 while maintaining their grip/hold on the second end 1106 of the tether 1100. This may allow the first end 1104 of the tether 1100 to travel through the ring 1220 thereby completely disengaging the tether 1100 from the belt 1200.

An aspect may include a kit, where the kit includes a tether as described herein, a belt as described herein, and a carrying bag or case.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings.

Unless the context clearly requires otherwise, throughout the description, the words "comprise," "comprising," "include," "including," and the like are to be construed in an inclusive sense as opposed to an exclusive or exhaustive sense; that is to say, in a sense of "including, but not limited to." Additionally, the words "herein," "hereunder," "above," "below," and words of similar import refer to this application as a whole and not to any particular portions of this application.

It will be appreciated that the devices, systems, and methods described above are set forth by way of example and not of limitation. Absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So for example performing the step of X includes any suitable method for causing another party such as a remote user, a remote processing resource (e.g., a server or cloud computer) or a machine to perform the step of X Similarly, performing steps X, Y and Z may include any method of directing or controlling any combination of such other individuals or resources to perform steps X, Y and Z to obtain the benefit of such steps. Thus method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It should further be appreciated that the methods above are provided by way of example. Absent an explicit indication to the contrary, the disclosed steps may be modified, supplemented, omitted, and/or re-ordered without departing from the scope of this disclosure.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A training device, comprising:

a tether including an elongated body having a plurality of discrete, substantially inelastic portions disposed between ends of the elongated body, wherein the plurality of discrete, substantially inelastic portions includes a central portion disposed about halfway along a length of the tether, a first end portion disposed along the length of the tether adjacent to a first end thereof, and a second end portion disposed along the length of the tether adjacent to a second end thereof, where each of the first end portion and the second end portion is at least 2.5 times longer than the central portion, where each of the plurality of discrete, substantially inelastic portions are separated from one another along the length of the tether by an elastic portion, and where each of the ends of the elongated body is configured for engagement with hands of a first user; and a belt structurally configured to wrap around a second user's body and including a securement mechanism structurally configured to secure the belt around the second user's body, the belt further including a ring on a back portion thereof, the ring having an opening for receiving at least one of the ends of the elongated body therethrough such that each of the ends of the elongated body is free for engagement with the hands of the first user, wherein, when the belt is secured around the second user's body and the tether is disposed through the ring, the training device is structurally configured to create a coupling between the first user and the second user when the first user secures each of the ends of the elongated body, wherein a tension is created in the tether when the second user moves away from the first user while the first user is securing each of the ends of the elongated body, and wherein the coupling between the first user and the second user is substantially released when the first user releases one end of the elongated body such that the released end is substantially unrestrained to traverse through the ring thereby fully disengaging the tether from the belt.

2. The training device of claim 1, wherein the elastic portion includes: a first elastic portion disposed between the first end portion and the central portion, and a second elastic portion disposed between the second end portion and the central portion.

3. The training device of claim 1, wherein the elastic portion includes a bungee.

4. The training device of claim 1, wherein the elastic portion includes a rubber cord covered by a fabric sheathing.

5. The training device of claim 1, wherein the plurality of discrete, substantially inelastic portions include a woven fabric strap.

6. The training device of claim 1, wherein the elastic portion is structurally configured to act as a shock absorber that dissipates energy such that the tether does not snap back and contact the first user when released.

7. The training device of claim 1, wherein the elastic portion is structurally configured to act as a shock absorber that allows the first user to withstand a relatively abrupt change in velocity of the second user when the first and second users are coupled.

8. The training device of claim 1, wherein the elastic portion is structurally configured to allow for substantially even tension from a portion of the tether engaged with the ring to each of the ends of the elongated body.

9. The training device of claim 1, wherein the elastic portion includes a rubber cord and the plurality of discrete, substantially inelastic portions include a woven fabric strap, and wherein engagement between the woven fabric strap and the rubber cord is facilitated by wrapping the woven fabric strap around the rubber cord, doubling over ends of the rubber cord, and securing free ends of the rubber cord with a rubber band.

10. The training device of claim 1, further comprising a hold disposed on at least one end of the elongated body, the hold structurally configured for engagement with at least one hand of the first user.

11. The training device of claim 10, wherein the hold includes a loop for placement of at least one hand of the first user through the loop for securing the loop around a wrist of the first user.

12. The training device of claim 10, wherein the hold includes a handle.

13. The training device of claim 10, wherein the hold includes a strap for strapping around a wrist of the first user.

14. The training device of claim 10, wherein the hold is disposed on both ends of the elongated body.

15. The training device of claim 14, wherein the tether is substantially symmetric about a central axis disposed between the ends of the elongated body.

16. The training device of claim 10, further comprising a second hold disposed on an opposite end of the elongated body from the at least one end.

17. The training device of claim 1, wherein the ring comprises a substantially circular shape and is made of steel.

18. A method of acceleration training, comprising:

wrapping a belt around a first user's body and securing the belt around the first user's body such that a ring included on a back portion of the belt is disposed on a back portion of the first user's body;

threading one end of a tether through the ring such that each end of the tether is free for engagement by a second user, the tether comprising a plurality of discrete, substantially inelastic portions disposed between the ends of the tether, where each of the plurality of discrete, substantially inelastic portions is separated from one another along a length of the tether by an elastic portion;

creating a coupling between the first user and the second user through the second user securing each of the ends of the tether;

creating a tension in the tether through the first user moving away from the second user while the second user secures each of the ends of the tether; and releasing the coupling between the first user and the second user through the second user releasing one end of the tether such that the released end is substantially unrestrained to traverse through the ring thereby fully disengaging the tether from the belt.

19. The method of claim 18, wherein the coupling is created by the second user performing one or more of (i) grabbing a hold disposed on one or more of the ends of the tether and (ii) looping one or more of the ends of the tether around a wrist of the second user.

20. The method of claim 18, wherein releasing the coupling causes a sudden burst of speed for the first user moving away from the second user.

* * * * *